US005290412A

United States Patent [19]

Saito et al.

[11] Patent Number: 5,290,412

[45] Date of Patent: Mar. 1, 1994

[54] APPARATUS FOR SEPARATING ELECTRODEPOSITED METAL IN ELECTROLYTIC REFINING

[75] Inventors: Hideomi Saito; Saburo Tanaka, both of Hyogo; Hiroyuki Morozumi, Tokyo; Akiyoshi Tatsui, Kagawa; Akira Yoshioka, Tokyo, all of Japan

[73] Assignee: Mitsubishi Materials Corporation, Tokyo, Japan

[21] Appl. No.: 950,227

[22] Filed: Sep. 24, 1992

[30] Foreign Application Priority Data

Jul. 23, 1992 [JP] Japan ..... 4-197266

[51] Int. Cl.[5] ..... C25D 17/00; C25C 7/08; C22B 7/00

[52] U.S. Cl. ..... 204/227; 204/279; 204/281; 266/160; 266/242; 266/901

[58] Field of Search ..... 204/281, 279, 227, 226; 266/160, 242, 182, 205, 901

[56] References Cited

U.S. PATENT DOCUMENTS 3,689,396 9/1972 Casagrande et al. ..... 204/281 X
4,045,301 8/1977 Wens et al. ..... 204/281 X
4,304,650 12/1981 Matsuo et al. ..... 204/281 X
4,562,996 1/1986 Stamp ..... 266/242
5,059,116 10/1991 Gillespie et al. ..... 266/901 X

*Primary Examiner*—Donald R. Valentine
*Attorney, Agent, or Firm*—Oblon, Spivak, McClelland, Maier & Neustadt

[57] ABSTRACT

A process for separating an electrodeposited metal from a cathode plate in electrolytic refining is disclosed. The cathode plate on which the metal is electrodeposited is first held. Then, heated air is blown toward the cathode plate and the electrodeposited metal thereon. As a result, the electrodeposited metal is separated from the cathode plate. An apparatus for carrying out the same process is also disclosed. The apparatus includes a separating furnace, a holding assembly, and a device for introducing heated air into the separating furnace. The holding assembly is attached to the separating furnace for holding the cathode plate in the furnace. The heated air-introducing device introduces heated air, blowing it against the cathode plate, whereby the electrodeposited metal is separated from the cathode plate.

7 Claims, 4 Drawing Sheets

APPARATUS FOR SEPARATING ELECTRODEPOSITED METAL IN ELECTROLYTIC REFINING

BACKGROUND ART

The present invention pertains to a process for separating an electrodeposited metal from a cathode plate in electrolytic refining, and to an apparatus specifically adapted to carry out the same process.

A conventional electrolytic refining process involves preparing as a cathode plate a starter sheet of the same metal as the target metal to be refined, and carrying out electrolytic refining by electrodepositing the metal to be refined on the cathode plate. Subsequently, the electrodeposited metal is melted together with the starter sheet, and cast into an ingot.

In the above process, however, a starter sheet must be prepared every time electrolytic refining is carried out. Furthermore, it is necessary to secure a suspension bar of a conductive material to the starter sheet in order to hold the sheet in an electrolytic cell and apply electric current to the sheet, and much workload is required for the securing task because the starter sheets to be accommodated in a single electrolytic cell reach a considerable number.

In order to circumvent the above disadvantages, a modified electrolytic refining process has been proposed as disclosed in Japanese Patent Application, B-Publication Number 59-43996 or Japanese Patent Application, B-Publication Number 63-42716. In this process, a mother blank formed of stainless steel or titanium is used, and the metal to be refined is electrodeposited thereon. Then, the electrodeposited metal is mechanically separated from the mother blank, and the mother blank is repeatedly employed.

However, since the metal is electrodeposited on the entire outer surface of the mother blank including the edge portions, the task of separating the electrodeposited metal from the mother blank has been very laborious.

Furthermore, in order to facilitate the separation of the electrodeposited metal, another modified process has been proposed which includes covering the edge portions of the mother blank with an edge protector of an insulating material, and electrodepositing the metal only on the front and rear surfaces of the mother blank without electrodepositing the metal on the edge portions. With this modification, the mother blank can be used repeatedly, but when separating the metal from the mother blank mechanically, the mother blank may be subjected to deformation or damage, or the edge protector may be damaged. Thus, it has been necessary to repair or reform the mother blank and the protector.

Moreover, since tin, lead, indium or the like is less hard, it has been very difficult to separate it mechanically.

SUMMARY OF THE INVENTION

It is therefore a primary object of the present invention to provide a process for separating an electrodeposited metal from a cathode plate by which the electrodeposited metal can be easily separated without damaging the cathode plate, so that the cathode plate can be repeatedly employed without any repair.

Another object of the present invention is to provide an apparatus specifically adapted to carry out the above process.

According to a first aspect of the present invention, there is provided a process for separating an electrodeposited metal from a cathode plate in electrolytic refining, comprising the steps of:

holding the cathode plate on which the metal is electrodeposited; and blowing heated air towards the cathode plate and the electrodeposited metal thereon to separate the electrodeposited metal from the cathode plate.

According to a second aspect of the present invention, there is provided an apparatus for separating an electrodeposited metal from a cathode plate in electrolytic refining, comprising:

a separating furnace;

holding means attached to the separating furnace for holding in the furnace the cathode plate on which the metal is electrodeposited;

means for introducing heated air into the separating furnace to blow the heated air against the cathode plate and the electrodeposited metal thereon, whereby the electrodeposited metal is separated from the cathode plate.

DETAILED DESCRIPTION OF THE INVENTION

Figure 1:
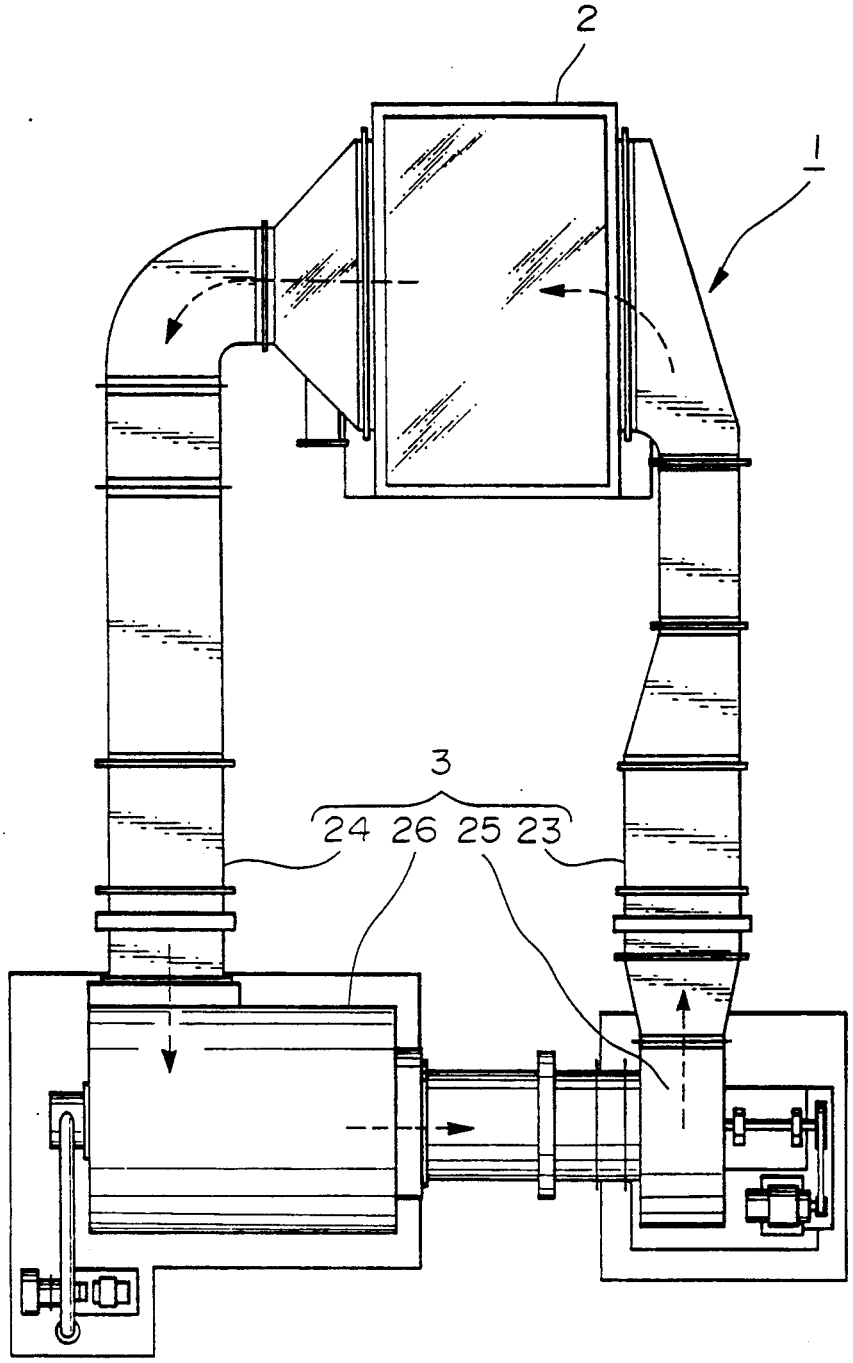
FIG. 1 is a schematic plan view of a separating apparatus in accordance with the present invention.

A separating process in accordance with the present invention is characterized by the steps of: (a) holding a mother blank on which a metal to be refined is electrodeposited; and (b) blowing heated air toward the mother blank and the electrodeposited metal thereon to separate the electrodeposited metal from the mother blank. The process is applied in the case where the metal to be refined is tin, indium, lead, copper or the like, while the mother blank, i.e., a cathode plate, is formed of a stainless steel, titanium or the like.

In the process of the present invention, the mother blank on which the metal to be refined is electrodeposited is first held in a prescribed chamber or the like using suitable means. Then, heated air of a prescribed elevated temperature is blown toward the mother blank and the electrodeposited metal thereon. As a result, the electrodeposited metal is heated by the hot air and separated from the cathode plate.

More specifically, the electrodeposited metal to be refined, such as tin, indium, lead or the like, has a greater coefficient of thermal expansion and a lower melting point than the mother blank of a material such as stainless steel or titanium. For example, tin, indium, and lead have coefficients of thermal expansion of $23.5\times10^{-6}$, $24.8\times10^{-6}$, and $29.0\times10^{-6}$, respectively, whereas stainless steel 316 L and titanium have coefficients of thermal expansion of $9.0\times10^{-6}$ and $8.9\times10^{-6}$, respectively. Furthermore, tin, indium, and lead have melting points of 232° C., 155° C., 327° C., respectively, whereas the same stainless steel and titanium have melting points of 1200° C. and 1725° C., respectively.

In this situation, when heated air having an elevated temperature less than the melting point of the electrodeposited metal is blown against the mother blank on which the metal is electrodeposited, the electrodeposited metal is subjected to greater thermal expansion than the mother blank, and is ultimately separated from the mother blank. Furthermore, when the temperature of the heated air is even more elevated so as to exceed the melting point of the metal, the electrodeposited metal begins to melt and fall from the mother blank. Thus, the electrodeposited metal is separated by blowing the heated air against the mother blank. This separation occurs due to the melting of the electrodeposited metal or a large thermal expansion of the electrodeposited metal relative to the mother blank.

As will be understood from the foregoing, it is preferable that the temperature of the heated air be regulated so that the electrodeposited metal is at least partly melted while leaving the mother blank unmelted in order to ensure separation. However, when copper or the like which has a relatively high melting point is to be refined, the temperature of the heated air may be regulated to a reduced temperature at which the electrodeposited metal is separated from the mother blank only due to the difference in thermal expansion between the electrodeposited metal and the mother blank.

As described above, in the process of the invention, the electrodeposited metal can be separated simply by blowing heated air, and hence separating work using mechanical means is no longer required, so that the electrolytic refining process is substantially simplified.

Next, an apparatus for carrying out the above process will be explained with reference to the drawings.

The apparatus, generally designated by the numeral 1, comprises a separating furnace 2, a device 3 or means for introducing heated air into the separating furnace 2, and a holding assembly 4 or means attached to the separating furnace 2 for holding mother blanks in the furnace 2.

Each mother blank, designated by M, is formed of a metal such as stainless steel or titanium, and has a rectangular shape. As is the case with the conventional mother blank, a suspension bar 7 of a metal similar to that of the mother blank is securely fixed to the upper end portion thereof by welding or using joining bolts. The suspension bar 7 is adapted to be engaged at one end thereof with an electric conductor when the mother blank M is placed in an electrolytic cell. The mother blank M is hung in the electrolytic cell by the suspension bar 7, and electric current is supplied to the mother blank M through the bar 7.

Figure 3:
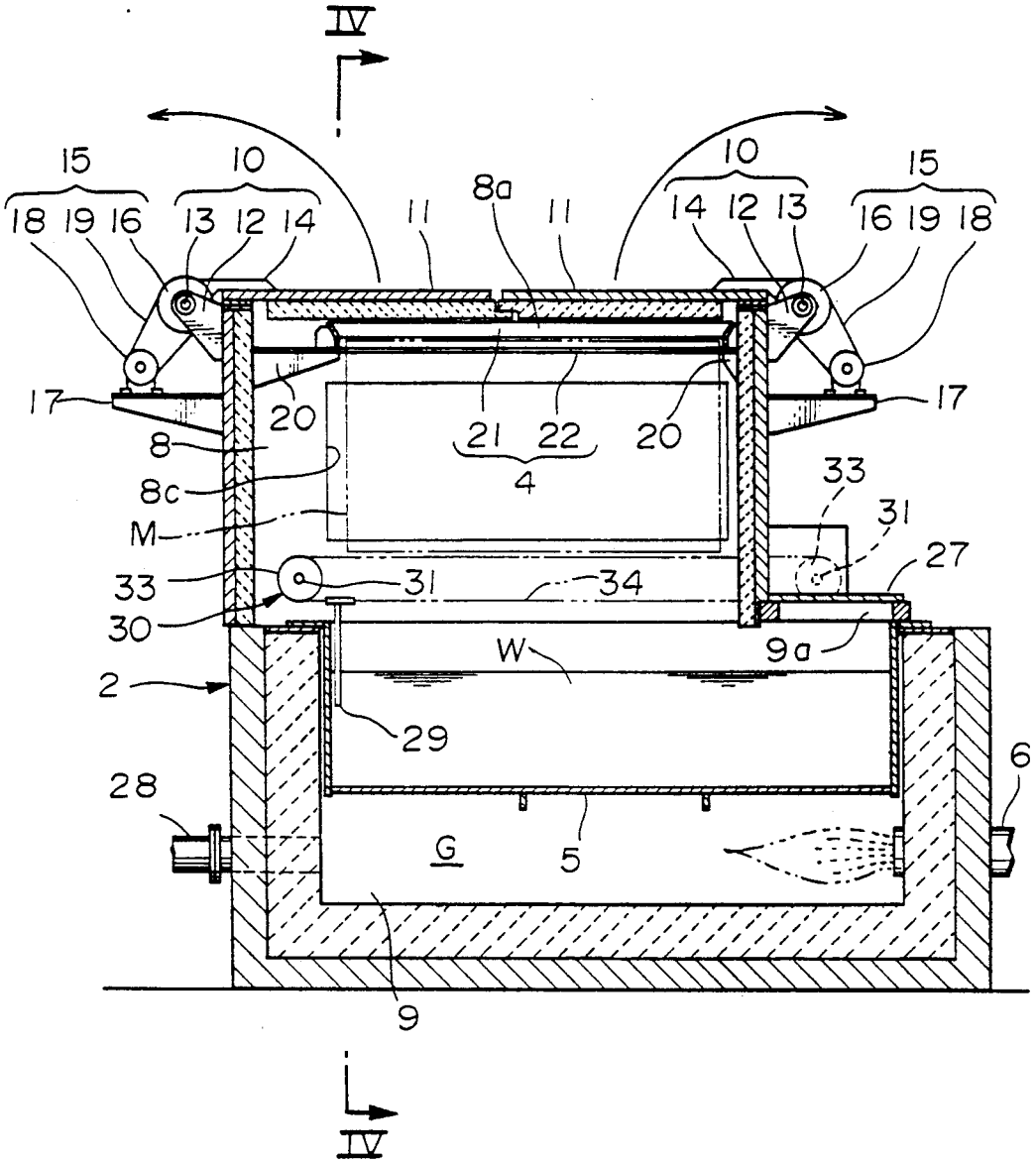
FIG. 3 is a longitudinal cross-sectional view of the part shown by FIG. 2.
Figure 4:
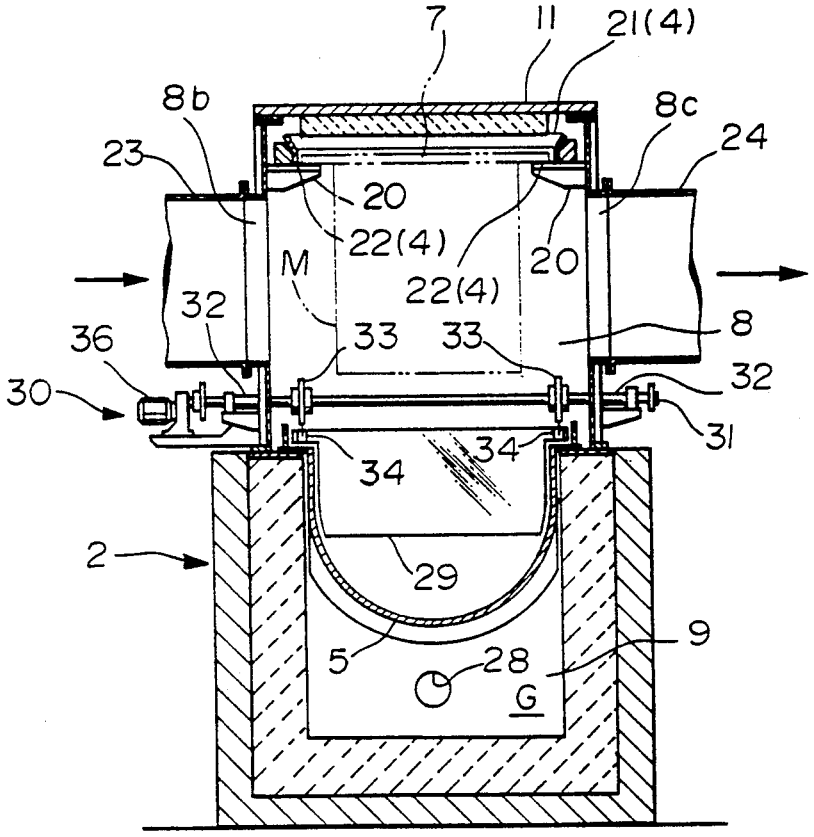
FIG. 4 is a cross-sectional view of the part shown by FIG. 2 taken along the line IV—IV in FIG. 3.

As shown in FIGS. 3 and 4, the separating furnace 2 includes an upper chamber 8 in which a prescribed number of the mother blanks M are placed, and a lower chamber 9 disposed below the upper chamber 8. The upper chamber 8 is open at its bottom while the lower chamber 9 is open at its top, and hence the upper chamber 8 and the lower chamber 9 are communicated with each other so that the electrodeposited metal separated from the mother blanks M will fall into the lower chamber 9.

The upper chamber 8 has an upper opening **8*a* for receiving the mother blanks. A pair of door leaves 11 are pivotally secured at one end to the upper ends of the peripheral walls of the chamber through hinge assemblies 10, so that the opening 8*a* is closed and opened by the door leaves 11. Each hinge assembly 10 includes a rod 13 rotatably supported by the upper end of the chamber wall through two brackets 12, and a pair of connecting plates 14 secured at one end to the two longitudinally spaced portions of the rod 13 and at the other end to the two longitudinally spaced portions of each door leaf 11**.

Figure 2:
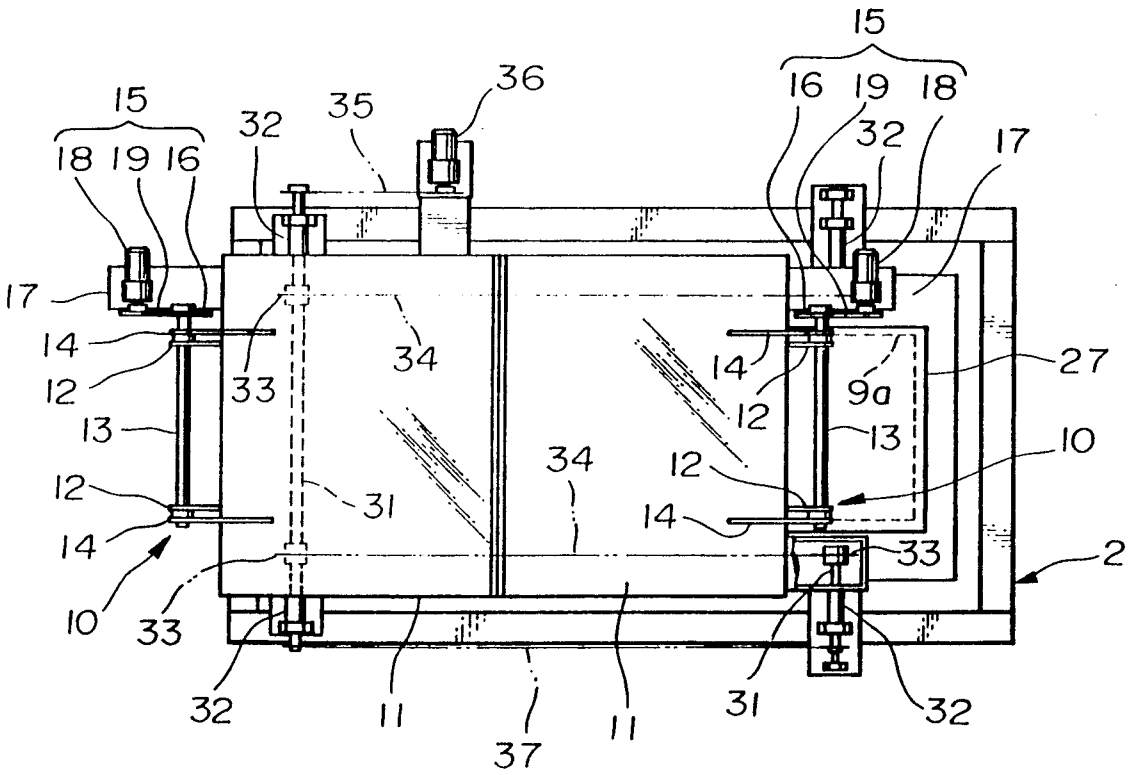
FIG. 2 is a plan view of a part of the apparatus of FIG. 1.

Furthermore, as shown in FIGS. 2 and 3, a drive mechanism 15 for opening and closing the above door leaves 11 is attached to one end of each rod 13. The drive mechanism 15 includes a sprocket 16 mounted on one end of the rod 13, an electric motor 18 disposed adjacent to the hinge assembly 10 and secured to the outer surface of the chamber wall through stays 17, and a chain 19 wound on a driving shaft of the electric motor 18 and the sprocket 16 for transferring the driving force of the motor 18 to the rod 13. Thus, when the electric motor 18 is actuated, the door leaves 11 are angularly moved in a reciprocal manner, so that the opening **8*a*** is opened and closed.

The holding assembly 4, which is disposed adjacent to the opening **8*a* of the upper chamber 8, includes a generally rectangular guiding member 21 having inclined faces sloping outwardly in the upper direction, and a pair of parallel supporting plates 22 disposed along the elongated frame portions of the guiding member 21 and secured to the inner wall of the upper chamber through a plurality of stays 20. The supporting plates 22 are formed so as to protrude slightly inward from the guiding member 21 such that the distance between the supporting plates is greater than the width of the mother blank M but is smaller than the length of the suspension bar 7. Thus, when inserted between the supporting plates 22, the mother blanks M are hung with the opposite ends of each suspension bar 7 being supported on the supporting plates 22. Additionally, the supporting plates 22** are dimensioned so as to have a length such that the mother blanks to be accommodated in a single electrolytic cell are all supported.

Furthermore, in the upper chamber 8, an air inlet **8*b* and an air outlet 8*c* are respectively formed through the peripheral walls opposed to each other, and all of the mother blanks M held by the holding assembly 4 are adapted to be located between the air inlet 8*b* and the air outlet 8*c*. Specifically, as shown in FIG. 4, the inlet 8*b* and the outlet 8*c*** are arranged so that the direction of the flow of the heated air is parallel to the front and rear surfaces of the mother blanks M in order to enhance the heating efficiency.

The aforesaid device 3 for introducing heated air is attached to the inlet **8*b* and the outlet 8*c*, and includes an air supply duct 23 connected to the inlet 8*b*, an air discharge duct 24 connected to the outlet 8*c*, a blower 25 connected to the upstream stream end of the air supply duct 23, and a burner 26 or heated-air producing means connected between the intake portion of the blower 25 and the downstream end of the discharge duct 24. With this construction, the air heated by the burner 26 is pressurized by the blower 25, and as indicated by the arrows in FIG. 1, the heated air is introduced into the upper chamber 8 of the separating furnace 2 through the air supply duct 23. Furthermore, the air discharged from the upper chamber 8 is returned through the discharge duct 24 to the burner 26** and reused repeatedly.

Moreover, accommodated in the lower chamber 9 is a melting pot 5 or container of a semicircular cross section which has closed opposite ends and an opening directed toward the upper chamber 8. As illustrated in FIG. 3, the pot 5 has an elongated shape so as to correspond to the side-by-side arrangement of the mother blanks M in the upper chamber 8. Thus, the electrodeposited metal separated from the mother blanks M is adapted to fall due to its own weight into the pot 5.

In addition, the pot 5 is received in the lower chamber 9 so as to define a space G under the pot 5, and a burner 6 is attached to the side wall of the lower chamber 9 for heating the air in the space G. Thus, the metal W received in the pot 5 is melted by heating the pot 5 with the burner 6. Additionally, a flue 28 for exhausting the air in the space G is secured to the side wall of the lower chamber 9 in opposed relation to the burner 6.

Furthermore, as best shown in FIG. 3, the lower chamber 9 as well as the pot 5 are formed somewhat greater in length than the upper chamber 8 so that one longitudinal end portion of the pot 5 is disposed at the outside with respect to the upper chamber 8. An opening 9*a* for drawing the molten metal from the pot 5 is formed in the upper portion of the above one end portion, and the opening 9*a* is covered with a removable lid member 27.

Moreover, the separating apparatus 1 further includes a raking member or plate 29 disposed in the pot 5 for raking dross from the molten metal W in the pot 5, and a driving mechanism 30 for moving the raking plate 29 toward the opening 9*a* of the lower chamber 9.

More specifically, a pair of shafts 31 are rotatably arranged on the lower chamber 9 through bearing members 32, in such a manner that the shafts extend transversely of the pot 5 and are spaced from each other in the longitudinal direction of the pot 5. Sprockets 33 are fixedly secured to opposite ends of each shaft 31, and a chain 34 is wound on the two sprockets secured at one end of each of the two shafts. In addition, as shown in FIG. 2, an electric motor 36 is connected to one of the shafts 31 through a chain 35, and another chain 37 is wound on the two sprockets secured at the other end of each of the two shafts. The above raking plate 29 is secured at its upper end to these two chains 34. Thus, the reciprocal movement of the electric motor 36 allows the raking plate 29 to move forward and backward along the entire longitudinal length of the pot 5. In the foregoing, the shafts 31, the bearing members 32, the electric motor 36, and the chains 34, 35 and 37 constitute the aforesaid driving mechanism 30.

In operation, the drive mechanism 15 is activated to pivot the door leaves 11 to open the opening 8*a* of the upper chamber 8. A number of the mother blanks M, which are picked out from the electrolytic cell using a crane or the like, are introduced into the upper chamber 8 through the opening 8*a*, and are located at a position as shown in FIGS. 3 and 4 by placing both ends of each suspension bar 7 on the opposed supporting plates 22 of the holding assembly 4. Subsequently, the drive mechanism 15 is again activated to pivot the door leaves 11 reversely to close the opening 8*a* of the upper chamber 8. Thereafter, heated air is introduced into the upper chamber 8 through the air supply duct 23 to heat the mother blanks M.

When the mother blanks are heated by the hot air, the metal electrodeposited on the mother blanks M is caused to partly melt and is separated from the mother blanks M.

The electrodeposited metal that has been separated fall into the pot 5 due to its own weight.

The pot 5 is heated in advance by the burner 6 giving consideration to the separation of the electrodeposited metal W. Therefore, the metal received in the pot 5 is melted therein.

The surface of the electrodeposited metal melted in the pot 5 may be partly oxidized before the completion of the separation of all the electrodeposited metal on the mother blanks, and dross floats on the melt. Therefore, by observing the formation of dross on the surface of the melt or at a prescribed time interval, the electric motor 36 of the driving assembly 30 is actuated, and the raking plate 29 is caused to move slowly toward the opening 9*a* of the lower chamber 9. As a result, the dross is moved to a position adjacent to the opening 9*a*. The dross thus gathered is removed from the opening 9*a* using a scoop or a suction pump.

Furthermore, the opening 8*a* is opened by activating the door leaves 11, and the mother blanks M from which the electrodeposited metal W is separated are picked out therefrom. After subjection to after-treatments such as washing, the mother blanks thus recovered are transferred to the electrolytic cells.

The mother blanks thus recovered are neither deformed nor damage, and hence they can be put into repeated use. When the molten metal W received in the pot 5 reaches a prescribed amount, it is drawn up by a suction pump or the like from the opening 9*a*, and is transferred to the casting facility at the next step.

The present invention will now be illustrated in more detail by way of the following examples.

EXAMPLE 1

Nineteen plates of stainless steel 316L were prepared as mother blanks, and a suspension bar of stainless steel 304 was secured to each mother blank. Each mother blank was 3.0 mm thick and had a size such that its portion to be immersed in the electrolyte was 1,000 mm×1,000 mm. furthermore, twenty anode plates of tin were prepared. Then, the mother blanks and the anode plates were placed in an electrolytic cell so that they are alternately disposed in opposed relation to each other at an intervening distance of 110 mm. Subsequently, electrolytic refining of tin was conducted under the conditions of a reflux rate of electrolyte (hydrofluosilic acid) of 20 liters per minute to 30 liters per minute, a solution temperature of 36° C., and an applied current of 1,450 amperes. The anode life was 336 hours. As a result, 1,000 kg of tin was electrodeposited on the mother blanks per cell.

Thereafter, the resulting mother blanks were introduced into the furnace and hot air of 330° C. was blown thereagainst for 30 minutes. As a result, all of the electrodeposits on the mother blanks were successfully separated therefrom.

The mother blanks from which the electrodeposited metal was thus separated were then recycled to the electrolytic refining step, and these procedures were repeated. However, little deformation or damage of the mother blanks was observed in spite of the repeated use.

EXAMPLE 2

The same procedures as in Example 1 were repeated except that electrolytic refining of indium was carried out using titanium mother blanks, and that the temperature of the hot air to be blown against the mother blanks was regulated to about 180° C. to about 200° C. As a result, the electrodeposited indium was completely separated from the mother blanks.

EXAMPLE 3

The same procedures as in Example 1 were repeated except that electrolytic refining of lead was carried out, and that the temperature of the hot air to be blown against the mother blanks was regulated to about 350° C. to about 400° C. As a result, the electrodeposited lead was completely separated from the mother blanks.

What is claimed is:

1. An apparatus for separating an electrodeposited metal from a cathode plate in electrolytic refining, comprising:

a separating furnace;

holding means attached to said separating furnace for holding in said furnace said cathode plate on which said metal is electrodeposited; and means for introducing heated air into said separating furnace to blow the heated air toward said cathode plate and said electrodeposited metal thereon, whereby the electrodeposited metal is separated from the cathode plate.

2. An apparatus as recited in claim 1, wherein said separating furnace includes an upper chamber in which said cathode plate is held, and a lower chamber disposed below said upper chamber, said upper chamber and said lower chamber being communicated with each other so that the electrodeposited metal separated from the cathode plate falls into said lower chamber.

3. An apparatus as recited in claim 1, wherein said heated air-introducing means includes means for producing the heated air, and an air supply duct connected between said heated air-producing means and said upper chamber of said separating furnace.

4. An apparatus as recited in claim 1, wherein said cathode plate includes a suspension bar secured to an upper end thereof, said holding means including a pair of parallel supporting plates fixedly secured to said upper chamber, said supporting plates being spaced from each other so that said cathode plate is hung between the supporting plates with the opposite ends of said suspension bar being supported on said supporting plates.

5. An apparatus as recited in claim 1, wherein said lower chamber includes a melting pot accommodated therein for receiving the electrodeposited metal separated from said cathode plate and melting the same.

6. An apparatus as recited in claim 5, further comprising a raking means attached to said pot for raking dross floating on the melt in said pot.

7. An apparatus as recited in claim 1, wherein said upper chamber includes an opening formed at a top thereof, a door means disposed on said opening, and a drive mechanism disposed adjacent to said opening for operating said door means to open and close said opening.

* * * * *

UNITED STATES PATENT AND TRADEMARK OFFICE

CERTIFICATE OF CORRECTION

PATENT NO. : 5,290,412

DATED : March 1, 1994

INVENTOR(S) : HIDEOMI SAITO ET AL

It is certified that error appears in the above-indentified patent and that said Letters Patent is hereby corrected as shown below:

On the title page, at [75] delete "Akiyoshi Tatsui, Kagawa".

Signed and Sealed this

Eleventh Day of October, 1994

*Attest:*

*Attesting Officer*

BRUCE LEHMAN

*Commissioner of Patents and Trademarks*